United States Patent [19]

van der Lely et al.

[11] 4,095,771

[45] Jun. 20, 1978

[54] DEVICES FOR MANUFACTURING WALL PARTITIONS

[76] Inventors: Cornelis van der Lely, 7, Brüschenrain, Zug; Hendricus Jacobus Cornelis Nieuwenhoven, Hirssattelweg, 6340 Baar, both of Switzerland

[21] Appl. No.: 708,356

[22] Filed: Jul. 26, 1976

Related U.S. Application Data

[63] Continuation of Ser. No. 536,037, Dec. 23, 1974, abandoned, which is a continuation of Ser. No. 314,996, Dec. 14, 1972, abandoned.

[30] Foreign Application Priority Data

Dec. 17, 1971 Netherlands ..... 7117333

[51] Int. Cl.[2] ..... B28B 7/22

[52] U.S. Cl. ..... 249/18; 249/81; 249/84; 249/91; 249/112; 249/142; 249/168; 249/172

[58] Field of Search ..... 249/13, 15, 16, 50, 249/163, 167–169, 172, 175, 177, 83, 39, 91, 112, 142

[56] References Cited

U.S. PATENT DOCUMENTS

| | | | |
|---|---|---|---|
| 975,108 | 11/1910 | Baker et al. | 249/169 |
| 1,925,733 | 9/1933 | Pandolfi | 249/168 |
| 2,924,962 | 2/1960 | Nettle | 249/13 |
| 3,129,481 | 4/1964 | Sullivan | 249/39 |
| 3,349,457 | 10/1967 | Frantz | 249/172 |
| 3,602,476 | 8/1971 | Iragorri | 249/15 |
| 3,708,148 | 1/1973 | Goransson | 249/172 |

*Primary Examiner*—Robert L. Spicer, Jr.
*Assistant Examiner*—John McQuade
*Attorney, Agent, or Firm*—Mason, Mason and Albright

[57] ABSTRACT

A mold for parts of a building such as the floors, walls, ceilings and roofs mounted on a supporting frame which rests, via a resilient member, on a supporting member through which extend heating tubes provided with heat radiating ribs. The bottom of the mold is the top of the heated space within the supporting member and frame. One or more of the sides of the mold are pivotable from projecting members extending outwardly from the supporting frame and clamping devices are provided to clamp the sides in position and against the floor mold. Columns may be included in the mold and are positioned by suspension members provided on the mold sides. A tile mat for positioning tiles may be placed on the floor of the mold. Reinforcement may also be positioned in the mold. For an outer wall, a layer of concrete followed by a layer of polystyrene foam and an inner layer of a lightweight material may be introduced and cast in succession in the mold. The inner mold sides may be profiled as desired. Also, the frames of doors or windows may be secured in the mold by bolts receivable in the bottom of the mold to which bridges are clamped across the frames. A plurality of molds are arranged in a row with a plurality of the heating tubes extending through the mold in succession.

21 Claims, 9 Drawing Figures

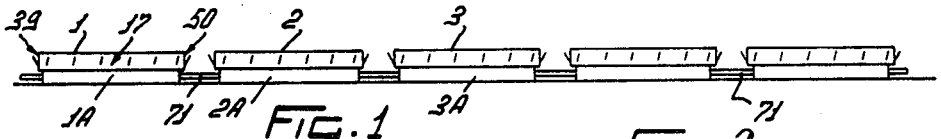
FIG. 1
FIG. 2
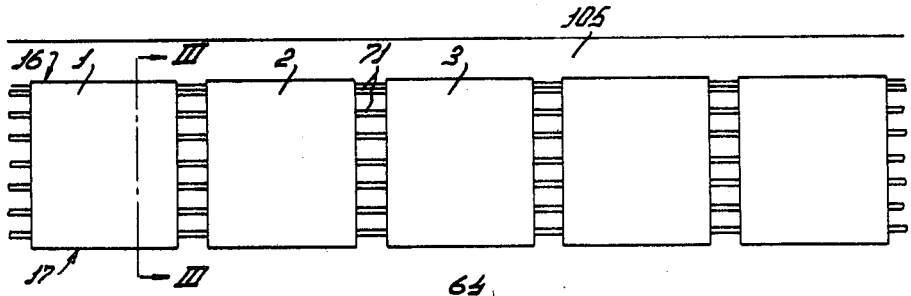
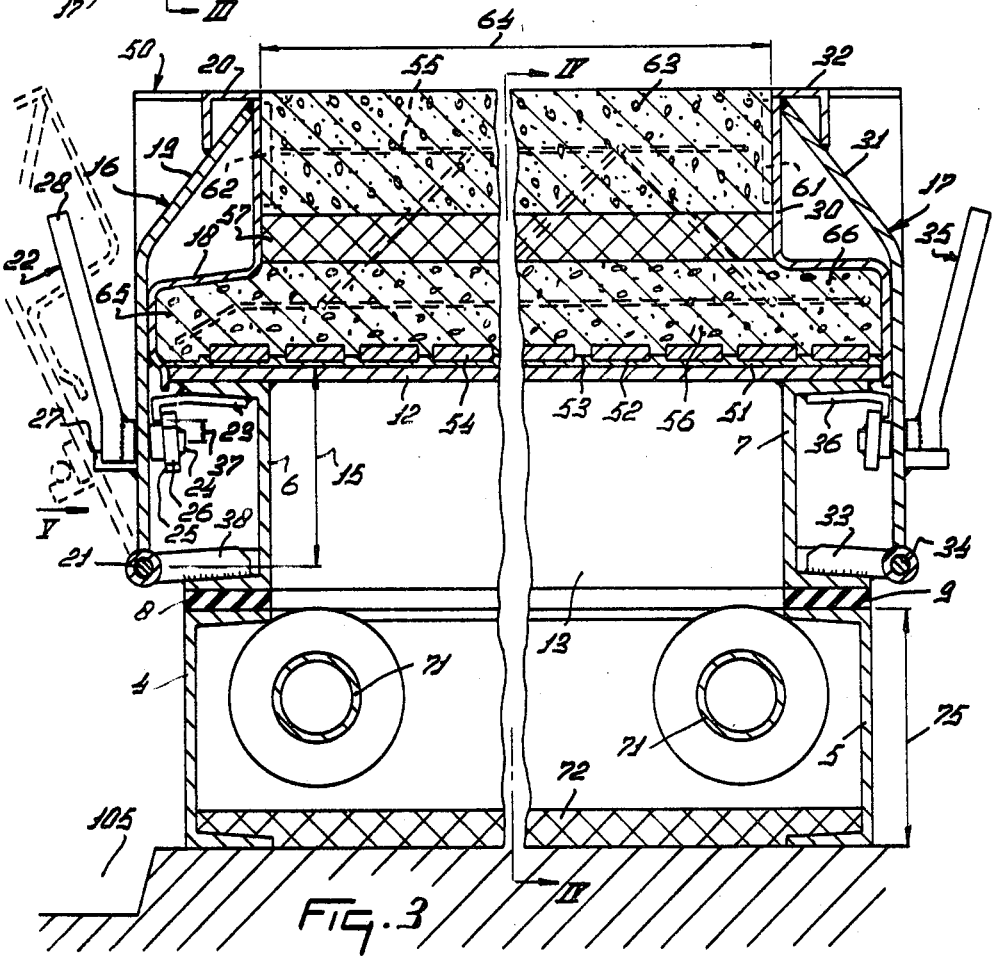
FIG. 3

DEVICES FOR MANUFACTURING WALL PARTITIONS

This is a continuation of application Ser. No. 536,037 filed Dec. 23, 1974, now abandoned, which is a continuation of application Ser. No. 314,996, filed Dec. 14, 1972, now abandoned.

SUMMARY OF THE INVENTION

This invention relates to devices for the manufacture of partitions intended as walls, floors, ceilings, or roots of buildings, such devices comprising a mold or jig consisting of a jig floor and upright jig sides.

One of the objects of the invention is to improve a device of this kind so that the manufacture of a partition is facilitated. According to one aspect of the invention, this can be achieved by providing a device for manufacturing a partition intended for use in a wall, a floor or a ceiling and/or a roof of a building, said device comprising a mold, or as also referred to a jig formed by a mold or jig floor and upright mold on jig sides,wherein at least one of the jig sides is arranged to be pivotable in such a way that the jig side can be displaced from a position in which it joins the jig floor. Thus, a partition made in the jig can be more readily removed from the jig while at the same time the formation of the partition can be readily carried out. The device can, moreover, be cleaned easily. The device is particularly suitable for the prefabrication of partitions used in the assembly of building sections enclosing a space and comprising one or more walls, a ceiling, a floor and/or a roof.

An advantageous form of the device embodying the invention can be obtained by arranging the pivotal axis at a lower level than the jig floor. The construction of the device is thus simplified, whilst the maintenance and the use of the device are facilitated. A simple embodiment is obtainably by arranging the jig side on a supporting member, which is linked to the further parts of the device by means of a pivotal shaft. The construction embodying the invention can be improved by providing the movable jig side with a locking member by which it can be fixed in a position in which it joins the jig floor. The adjustment of the jig and the removal of a formed partition are thus improved so that the manufacture of the partitions can be carried out rapidly.

According to a further aspect of the invention, there is provided a device for the manufacture of a partition intended for a wall, a floor or a ceiling and/or a roof of a building, said device comprising a jig formed by a jig floor and upright jig sides, wherein facing surfaces of two opposite jig sides are provided with suspension means comprising safety members which join wall columns to be arranged in the jig so as to fix the positions thereof, at least one of the safety members being removable from the position in which it fixes the position of a wall column in the jig. Thus, columns to be arranged in a partition can be rapidly set in position in the jig, which position is fixed for the manufacture of the partition. A simple structure is obtainable by having a safety member on a plate arranged on the inner surface of the jig side. An advantageous construction of a device embodying the invention is obtained by having a safety member removable from its fixing position by being fastened to a pivotable jig side. In this case the safety member can be secured in a simple manner to the jig side, whereas the position of the safety member on the jig side is invariable. An advantageous embodiment can be obtained by providing a safety member near each of the ends of two opposite jig sides. This permits manufacturing a partition in a simple manner, which partition comprises wall columns at two opposite edges. This construction is particularly advantageous for fastening the partition in a space-enclosing building section comprising one or more walls formed by one or more partitions, a ceiling and/or a roof and a floor.

A device of the kind set forth for the manufacture of partitions can be effectively utilized by fastening the jig to a supporting frame arranged on a supporting member, the supporting member and the supporting frame substantially enclosing a space inside of which a heating element is arranged. This is conducive to shortening the manufacturing time of each partition so that the device can be economically used. An advantageous embodiment is obtained by using a heating element supplying hot air.

According to a further aspect of the invention, a device of the kind set forth comprises a jig plate arranged on the jig floor and fitting around a door or window frame to be fastened to the jig floor and to be arranged in the partition. In this way a door or window frame can be readily arranged in a partition, while the jig plate facilitates the arrangement of the frame in the partition.

Also disclosed is a method of manufacturing a partition by means of a device embodying the invention, in which, after the pivotable jig sides are arranged in place, reinforcement is arranged in the jig on the jig floor and subsequently concrete or other material is cast in the jig for the formation of at least part of the partition. In this method it is simple to arrange a door or window frame in the partition, when a frame is fastened to the jig floor and at least one jig plate is arranged around the frame on the jig floor, the material being subsequently cast on the jig plate around the frame. An advantageous method is obtained when at least one wall column is arranged between safety plates of opposite jig sides, after which a layer of concrete or other material is cast in the jig to join the column.

BRIEF DESCRIPTION OF THE DRAWINGS

For a better understanding of the invention, and to show how the same may be carried into effect, reference will now be made, by way of example, to the accompanying drawings, in which:

FIG. 1 is a side elevation of a number of jigs arranged in a row and forming a jig line or part of a jig line, FIG. 2 is a plan view of the jig line shown in FIG. 1, FIG. 3 is an enlarged sectional view of a jig taken on the line III—III in FIG. 2.

DESCRIPTION OF THE PREFERRED EMBODIMENTS

Figure 4:
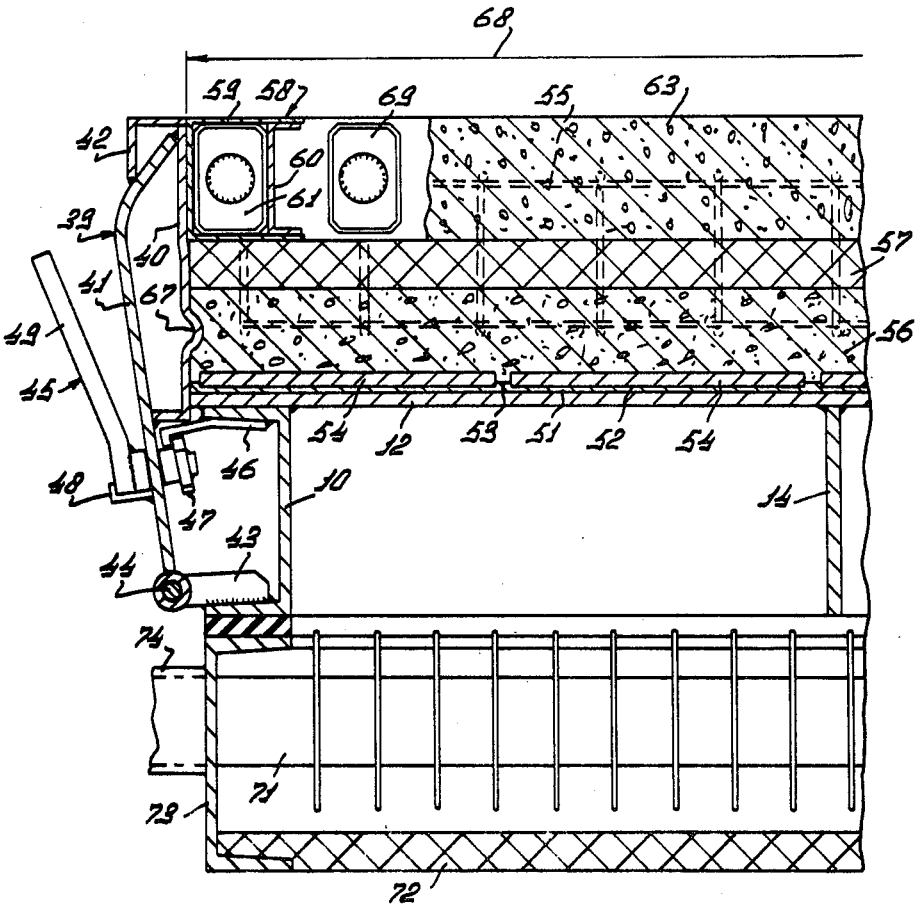
FIG. 4 is a sectional view of the jig taken on the line IV—IV of FIG. 3.

Referring to FIGS. 1 and 2, these Figures show a plurality of jigs 1, 2 and 3 arranged in a row and forming a jig line. The jigs are arranged on supporting members 1A, 2A and 3A respectively, disposed on the floor and anchored therein or thereto. As shown in FIG. 3, a supporting member comprises two longitudinal beams 4 and 5, extending parallel to the jig line. A jig comprises two beams 6 and 7, which are arranged on the longitudinal beams 4 and 5 with the interposition of rubber strips 8 and 9. The ends of the parallel beams 6 and 7, which have a length in accordance with the desired jig width, are interconnected by parallel beams 10, only one of which is visible in FIG. 4. To the longitudinal beams 6 and 7 and the connecting beams 10 forming a supporting frame for the jig is fastened a rectangular jig plate 12, beneath which connecting ridges 13 and 14 are arranged between the longitudinal beams and the connecting beams. The beams 6, 7, 10 and the beam corresponding with the beam 10 are formed by channel-section profiles whose horizontal limbs are orientated away from each other.

A jig comprises, parallel to the beams 6 and 7, side walls 16 and 17. The sidewall 16 has a jig side 18 shaped in the desired form and held by a supporting member 19 and reinforced at the top by an angle-section iron 20. The angle-section iron 20 and the supporting member 19 extend over the whole length of the jig side 18. The supporting member 19 is arranged on arms 38 so as to be pivotable about a pivotal pin 21 by the bottom side. The arms 38 are secured to the lower limb of the beam 16 and the pivotal pin 21 is located at a distance 15 beneath the top side of the jig plate 12, forming the jig floor. The distance 15 is approximately equal to the height of the beam 6. The supporting member 19 comprises locking members 22 having a shaft 24 journalled in the supporting member 19. The shaft 24 is provided with a rotatable clamping guide 25, which is adapted to co-operate with a fastening member comprising a hook 23 arranged on the upper limb of the beam 6. The clamping guide 25 is arranged slightly obliquely to the shaft 24. The clamping guide 25 is formed by a round disc having at its circumference a straight side 26, which is spaced apart from the line of the shaft 24 by a distance 29 (FIG. 5) which is smaller than the distance 37 (FIG. 3) of the lower side of the hook 23 from the centre line of the shaft 24. The locking member 24 comprises a lever 28 and at a distance from the shaft 24 a stop 27 is arranged on the supporting member 19. The beam 7 has secured to it the sidewall 17 having a jig side 30. The jig side 30 is held by a supporting member 31 and is provided on the top side by an angle-section iron 32. The sidewall 17 is fastened to arms 33 by means of a pivotal pin 34. The arms 33 are arranged on the beam 7. The sidewall 17 has a locking member 35, the construction of which is similar to that of the locking member 22 so that a further description may be omitted. The locking member 35 co-operates with a hook 36 on the beam 7 corresponding with the hook 23 on the beam 6. In accordance with the length of the side-walls the number of locking members 22 and 35 may be chosen at will. Preferably the locking members are arranged along the sidewalls at intervals of about 50 cms.

Along the beam 10 a sidewall 39 is arranged, which has a jig side 40. The jig side 40 is held by a supporting member 41 and is reinforced at the top by an angle-section iron 42. The supporting member 41 is fastened to arms 43, secured to the lower limb of the beam 10. The supporting member 41 is linked to the arms 43 by means of pivotal pins 44. The supporting member 41 has one or more pivotal pins 45, which co-operate with hooks 46 secured to the upper limb of the beam 10. In the same manner as described for the locking pin 22 in FIGS. 3 and 5 the locking member 45 comprises a clamping guide 47 corresponding with the clamping guide 25. Near the locking member 45, which comprises a lever 49, a stop 48 is fastened to the supporting member 41. Opposite the sidewall 39 a sidewall 50 (FIG. 1) is arranged and corresponds with the sidewalls 39 and is not shown in detail in the Figures.

On the jig floor 12 the jig sides 18, 30, 40 and the jig side connected with the sidewall 50 enclose a jig space in which a partition can be prefabricated. The jig sides are held in contact with the jig floor by the locking members. The clamping guides such as the guide 25, having an inclined position relative to the shaft, clamp the jig sides against the jig floor, when the locking members are tightened. The partition to be made in the jig shown in FIGS. 3 and 4 may serve as an outerwall of a building. A tile mat 51 is arranged on the jig plate 12, forming the jig floor, the profile of said mat being such that cavities 52 are formed between ridges 53 of the mat. Tiles 54 are arranged in the cavities 52. Subsequently a reinforcement network 55 is arranged in the jig space. Then wall columns 58 are arranged along the jig sides on the sidewalls 39 and 50, which is only illustrated for a wall column 58 to be arranged along the jig side 40. The wall column 58 is formed by a channelsection sheet 59 inside of which a channel-section sheet 60 is arranged so that these two channel-section sheets form a hollow beam having projecting limbs. The jig sides 18 and 30 are provided with suspension or holding means referred to herein as safety members 61 and 62 respectively at the area where the ends of the column 58 join the jig sides 18 and 30. The safety members 61 and 62 are formed by plates of such a shape that the hollow beam accurately fits around said plates (FIG. 4). The columns 58 have a length equal to the distance 64 between the jig sides 18 and 30. The distance between the safety plates is shorter than the length of the columns 58. In order to arrange the columns in place at least one of the jig sides with the safety members associated herewith can be arranged on the jig floor as shown in FIG. 3 only after the columns have been arranged in the jig. When the jig is closed by moving the jig side concerned towards the jig floor, the wall column is enclosed between the jig sides and be fixed in its position in the jig, since the safety plates fit accurately in the ends of the hollow space of the wall column. Then a layer 56, for example, of hard concrete is cast on the tiles 54. This layer 56, in which part of the network 55 is embedded, is covered by an insulating layer 57, for example, of polystyrene foam. A layer 63, for example, of light concrete consisting of sand, cement and a filler of lightweight material, for example, expanded clay, is cast between the wall columns 58 and the corresponding wall columns along the jig side on a sidewall 50 and on the insulating layer 57. The wall columns such as 58 may be provided with anchors and, if desired, be secured to the reinforcement 55 for establishing a satisfactory connection with the layer 63. In this manner a partition can be formed in the jig so as to comprise two layers of concrete and an insulation layer sandwiched between. The reinforcement network 55 is such that the layers 56 and 63 of concrete are interconnected thereby. The outer side of this partition, formed by tiles 54, may effectively serve as an outer face of an outer wall. The layer 56 then constitutes an outer layer and the layer 63 an inner side of the wall. A partition thus formed may be employed particularly efficaciously in the prefabrication of space-bounding building sections comprising each a floor, a ceiling and/or a roof and two or more walls formed by partitions.

The distance 64 between the jig sides 18 and 30 may, as in this embodiment, be chosen so that the layer 63 corresponds to the height of a room or other space to be formed in the section. The wall column 58 and corresponding columns form the vertical wall columns which may be secured by the lower and upper ends, for example, to metal beams of the floor and the top of the section to be formed.

FIG. 3 shows that the layer 56 extends by a portion 65 and on the other side by a portion 66 beyond the layer 64 of the inner side 63. The portion 65 may effectively form an outer wall portion, which extends along at least part of the floor height of the building in which the partition is used as a wall or downwardly beyond the bottom of the section to be made. The portion 66 may form a part of the outer wall layer joining the top of the roof of a building or a ceiling and/or roofing of the section.

The jig side 40 and the corresponding jig side on the sidewall 50 have embossed parts 67 forming a groove in the vertical sides of the outer layer 56. The grooves between the contacting sides of two adjacent prefabricated partitions form a water gutter. The distance 64 shown in FIG. 3, which may be about 265 cms, determines the height of a partition. The distance 68 between a sidewall 39 and 50 determines the width of the partition. It will be obvious that these dimensions may be chosen in accordance with the size of the partitions to be made.

In the embodiment shown in FIG. 4 the outer layer 56 and the inner layer 63 with the wall columns 58 have the same width. It is possible, however, to provide a width of the layer 63 with the wall columns 58 which differs from the width of the layer 56. For this purpose, for example, the wall column 58 may be arranged at a distance from the jig side 40. For this purpose the jig sides 18 and 30 may have, apart from the safety members 61 and 62, a further set of safety members, one of which is shown in FIG. 4, and designated by reference numeral 69. If the wall column 58 is arranged between the plate 69 and the corresponding plate, before the layer 63 is cast, the layer 63 is narrower than the distance 68.

Along the jig sides 18 and 30 more safety members such as the safety members 61 and 69 may be provided at will. The wall columns 58 may be arranged at a distance from the jig side 50 and a corresponding wall column is arranged in contact with the jig side 50 before the casting operation. In this manner the layers 56 and 57 project only on one side beyond the layer 63. It will be obvious that in this manner the edges of the partitions may be formed at will. This may also be obtained by shaping, for example, the jig sides 18, 30 and 40 in a different form than shown in FIGS. 3 and 4. The angle section irons, for example, 20, 32 and 42 may effectively serve as supports for members by means of which the top side of the layer 63 can be smoothed.

In order to dry the cast partitions rapidly, a heating element is arranged beneath the jig plate 12. It may comprise a plurality of adjacent rib tubes 71, which extend parallel to the supporting beams 4 and 5. These tubes may extend over the whole length of the jig line. The space beneath the jigs is completely closed by the fact that the supporting beams 4 and 5 are interconnected by transverse beams located beneath the connecting beam such as the beam 10, as for example, the transverse beam 73 in FIG. 4. Between the spaces formed beneath the jigs, for example, the spaces beneath the jigs 1 and 2, the tubes 71 may be provided with an insulating layer 74. The supporting beams 4 and 5 of a jig are not connected with the supporting beams of a next jig. Thus, when a jig is vibrated for ensuring a satisfactory distribution of the cast material, the vibrations will not affect a further jig. The rib tubes 71 are free of the supports formed by the beams 4, 5, 73 and the beam corresponding with the beam 73, preferably to an extent such that the vibrations are not transferred via the tubes 71 from one jig to another. The transfer of vibrations is furthermore reduced by the fact that the supporting frames of the jigs are arranged on rubber strips, such as the strips 8 and 9 of FIG. 3. Since the beams 4 and 5 do not extend from one jig to the other, there is left an easy path between the jigs, for example, between the jigs 1 and 2. It may then be advantageous to arrange the rib tubes from one jig to the other in a depressed part of the floor, instead of arranging them above the ground. Inside the space beneath the jig plate 12 the floor is covered by an insulating layer 72. If desired, also the supporting beams such as the beams 4 and 5 and the beams of the supporting frame, such as the beams 6, 7 and 10, may be provided on the inner or outer side with insulating material so that loss of heat is reduced. Although this embodiment comprises a heating system formed by rib tubes, the system may be constructed differently. A hot liquid may be passed through the tubes 71. As an alternative, hot air may be used for heating the spaces beneath the jigs.

Figure 5:
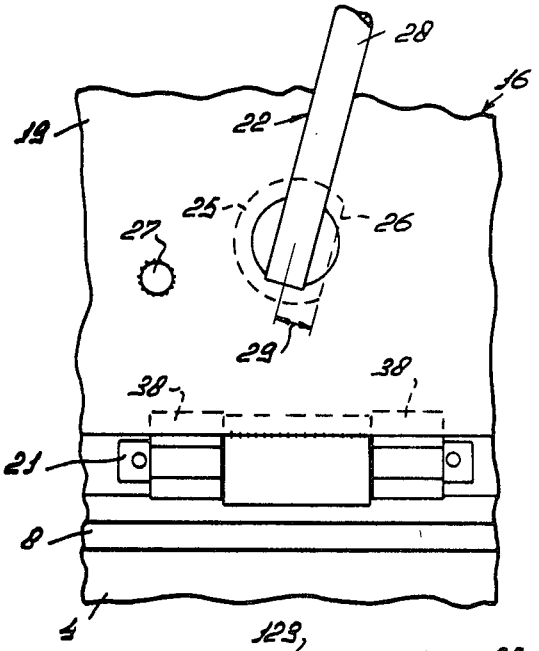
FIG. 5 is an enlarged elevation of a locking device viewed in the direction of the arrow V in FIG. 3.

In order to remove the partitions the jig sides 18, 30, 40 and 50 can be tilted away. For this purpose the locking members, such as the locking members 22, 35 and 45 can be turned about their shafts so that the flat sides of the clamping guides 25 shown in FIG. 4 arrive between the curved ends of the hooks 23, 36 and 46 respectively. Then the sidewalls concerned can be turned away about the pivots 21, 34 and 44 into a position as is shown by way of example in broken lines for the jig side 18 in FIG. 3. In order to fix the position of the handles of the locking members so that the edge 26 can move beneath the hooks, the stops such as the stop 27 of FIG. 5 are provided. If desired, stop lugs may be provided for determining the tilted position of the jig sides. One or more jig sides may be tilted away to an extent such that they get to a lower level than the top side of the floor plate 12 of the jig. This may be important for the removal of the manufactured partitions. Since the jig sides can be tilted away, the jig plate and the jig sides can be cleaned readily. Cleaning can be carried out in a satisfactory manner because all jig parts are exposed completely when the jig sides are turned out of the positions in which they join the jig floor. Dirt emanating from the jig parts can be swept into a gutter 105 extending along the jig line at the side of the jigs. Viewed on plan (see FIGS. 2 and 3) the gutter is located preferably beneath one side of the jig floor.

Figure 7:
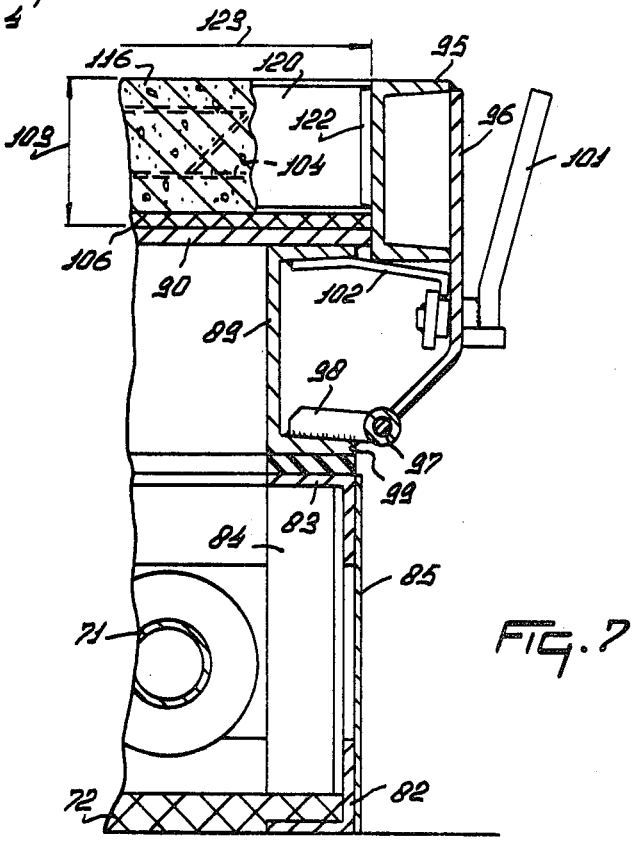
FIG. 7 is a sectional view of the jig of FIG. 6 taken on the line VII—VII in FIG. 6.
Figure 6:
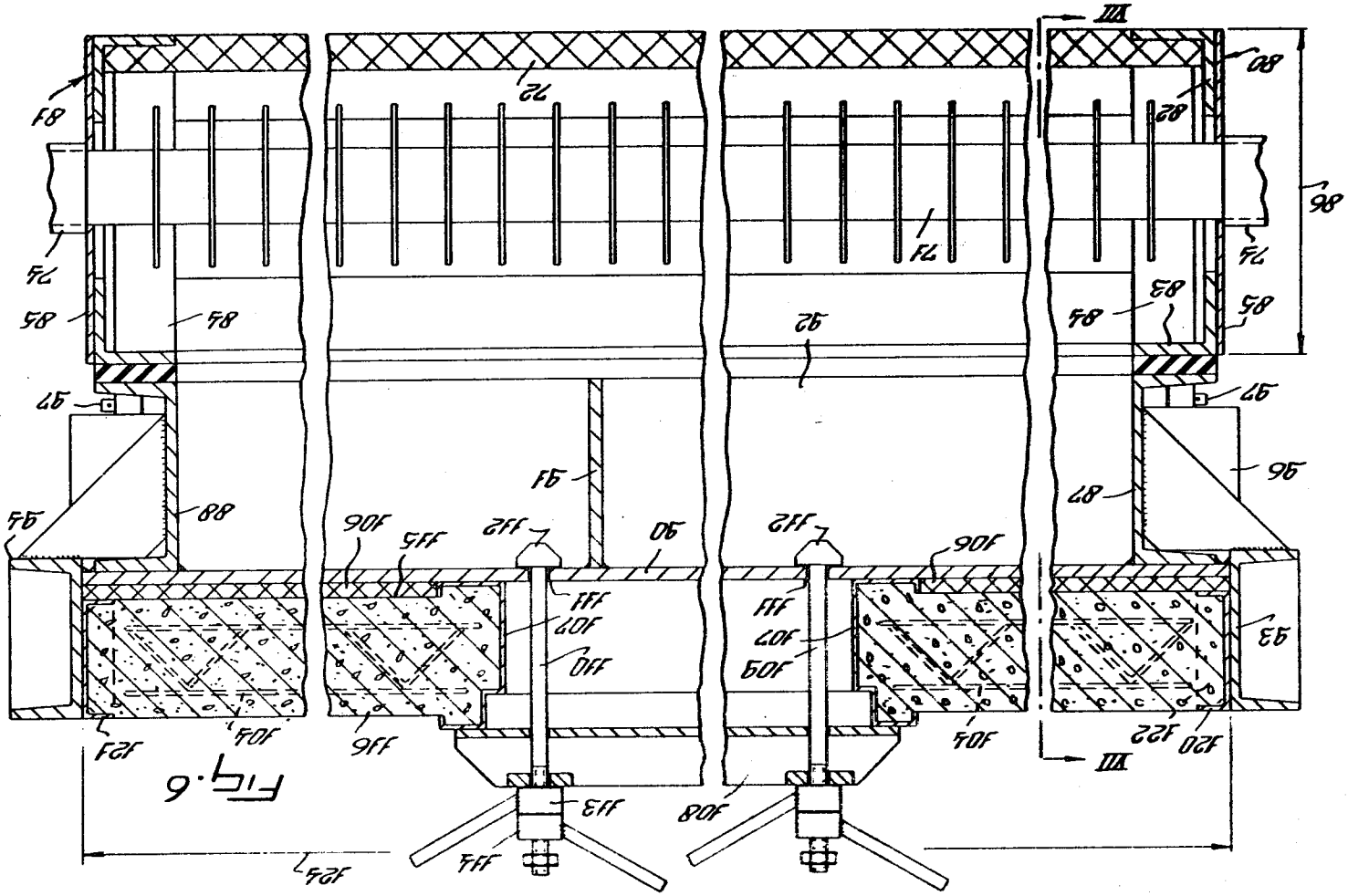
FIG. 6 is a sectional view of a second embodiment of a jig, the section being taken in the same manner as in FIG. 3 for the first embodiment.

FIGS. 6 and 7 show a further embodiment. In this case the beams of the supporting members corresponding with the beams of the supporting members, for example, the beams 4 and 5 of the first embodiment, are replaced by supporting beams 80 and 81 formed by frameworks. It is shown for the framework 80 that it comprises angle-section irons 82 and 83 on the top and bottom sides respectively, interconnected by struts 84 formed by angle-section irons. On the outer side the supporting beams are covered by cover plates 85. The supporting beams 80 and 81 have a height 86, which exceeds the height 75 of the supporting beams 4 and 5. On the supporting beams 80 and 81 is arranged a supporting frame for a jig. This supporting frame comprises four frame beams arranged in a rectangle, of which the FIGS. show the beams 87, 88 and 89. The beams 87 and 88 are parallel to the supporting beams 80 and 81. The frame beams of the supporting frame, like in the first embodiment, are arranged on the supports by means of rubber strips. A jig floor 90 is arranged on the top side of the supporting frame, the bottom side thereof being reinforced by stiffening ribs 91 and 92, which are secured to the plate 90 and between the beams 87 and 88 and the beam 89 and the corresponding opposite beam respectively. Jig sides 93 and 94 formed by channel-section beams are arranged parallel to the beams 87 and 88. These jig sides are rigidly secured to the jig floor plate 90 and by struts (FIG. 6) to the beams 87 and 88. Between the ends of the jig sides 93 and 94 are arranged a jig side 95 and a corresponding opposite jig side (not shown). The latter jig side, like the jig sides 93 and 94, is rigidly secured to the supporting beams concerned and to the jig floor 90. In this embodiment only one jig side, that is to say the jig side formed by the channel-section beam 95, is pivotally arranged in the device. The jig side 95 is secured to a supporting member 96, which is pivoted to arms 98 by means of a pivotal shaft 97. The arms 98 are secured to the lower limb 99 of the horizontal limbs of the channel-section beam 89. The supporting member 96 is provided with a locking member 101, which corresponds with the locking members 22 of FIGS. 3 and 5. The locking member 101 is therefore not described further.

The locking member 101 co-operates with a locking hook 102 which corresponds with the locking hook 23 of the first embodiment. The jig sides 93, 94 and 95 extend by a height 103 above the top sides of the floor plate 90 which height is considerably smaller than the distance over which the jig sides 18 and 30 extend above the top side of the floor plate 12. The jig shown in FIGS. 6 and 7 serves for manufacturing a partition of casting material, for example, concrete, the thickness being smaller than that of the partition in the first embodiment. The jig shown in FIGS. 6 and 7 is particularly suitable for the manufacture of inner walls to be employed in the assembly of space-bounding building sections comprising a plurality of partitions, a bottom and a ceiling. For casting the inner wall a jig plate 106, for example, of synthetic resin is arranged on the jig floor 90, the material being cast on said plate. If an inner wall has to comprise one or more frames for a door and/or a window, these frames can be fastened to the floor plate 90 as is shown in FIG. 6 which shows a frame 107 for a door. The frame 107 is secured to the jig floor 90 by means of two clamping bridges 108, only one of which is shown. Each of the bridges is secured in place by means of two bolts 109 and 110. In order to arrange the bolts 109 and 110 in the jig floor 90 rectangular holes 111 are provided therein. The bolts 109 and 110 have rectangular heads 112 corresponding to the holes 111. The bolt heads can be passed through the holes and after a turn they are hooked beneath the jig floor as is illustrated in FIG. 6. When the nuts 113, above which counter-nuts 114 are provided, are tightened, the bolts are fixed in place. The thickness of the jig plate 116 is such that it corresponds to the distance over which the frames project from the flat sides 115 of the partition. At the top the frames project above the side 116 of the jig over a desired distance.

Along the jig sides 93 and 94 wall columns formed by channel-section beams 120 and 121 are arranged. These beams are secured against displacement by safety plates 122 arranged on the jig side 95 and the opposite, corresponding jig side. These safety plates fit in the space formed by the channel-section beams 120 and 121. The safety plates 122 can be compared with the safety plates 61 and 62 of the first embodiment. The columns 120 and 121 are arranged by one end on the safety plates secured to the jig side located opposite the jig side 95. After the beams 120 and 121 are arranged in place, the jig side 95 is turned about the pivotal shaft 97 into the position in which it joins the jig floor 90 as shown in FIG. 7. When the jig side 95 is moved into said position, the safety plate 122 will join inside the sides of the parts of the beam 120 and thus fix the beam 120 in its position in the jig. The locking members 96 thus clamp the jig side 95 against the jig floor 90 because the clamp guide of the locking member grips behind the hook 102 and is in an oblique position relative to the rotary axis of the locking member. Although the safety members are formed here by plates, which join the inner sides of the wall columns so as to fix the position, they may be constructed in a different way. They may be formed by one or more parts co-operating in a different manner with the beams so as to fix the position. The safety members can be moved out of the fixing position by being arranged on the movable jig sides. As an alternative the safety members themselves may be movably arranged, for example, in the jig sides so that in the case of a fixed position of the jig sides the safety members can yet be removed or set in the fixing position in which the columns are fixed in place in the jigs. The advantage thereof is that the jig sides need not be turned away for arranging the wall columns in place.

Before the partition is cast in the jig, a reinforcement 104 is arranged in place, after which the material is cast in the jig on the jig plate 106 around the frame 107 and inside the beams 120 and 121. The frame 107 and the beams 120 and 121 are provided with anchors embedded in the cast material so that these parts are satisfactorily connected with the partition. In view of the smaller thickness of the wall, the supporting beams such as the beams 80 and 81 are slightly higher than the height 75 of the beams 4 and 5 of the supporting members 1A, 2A and 3A. Thus a satisfactory working height is obtained also in this embodiment. When the partition has sufficiently dried, the jig side 95 can be turned away by loosening the locking members 101 and by turning the support 96 with the jig side 95 around the pivotal shaft 97. Since the wall formed in the jig shown in FIGS. 6 and 7 on the jig floor is flat and is provided along the sides only with the beams 120 and 121, the partition can be slipped or lifted from the jig, after the jig side 95 has been removed, when the clamping beams 108 with the bolts concerned are taken away. Owing to the simpler shape of the partition to be cast in the jig it is not necessary for all jig sides to be tiltable. It will be obvious that at will only two parallel jig sides of a rectangular jig have to be tiltable, whereas the other two parallel sides are secured in place. As a further alternative, two jig sides being at an angle to each other may be tiltable, whereas the other two jig sides are rigidly secured to the jig. Although in the embodiments shown the jigs are rectangular in shape, the jig may have a different shape, whilst at will one or more jig sides are tiltable.

As in the preceding embodiment, that shown in FIGS. 6 and 7 has the bottom between the supporting beams covered by a layer of insulating material. If desired, the sides of the beams of the supporting members may also be covered by insulating material. The wall columns 120 and 121 form vertical beams of the partitions which may be secured, for example, to beams of floor plates and ceilings so that the partition can form a space-bounding section. In the direction of the beams 120 and 121 the distance 123 corresponds with the distance 64 of the first embodiment. The width of the partition measured in the direction of the arrow 124 may be chosen at will. A jig construction in the embodiments described above like variants of the jig constructions shown, may be successfully employed in jig lines where a plurality of partitions are made. Thus prefabricated partitions are obtained for use in erecting a building. Although in the embodiments shown the partitions serve as walls for a building, the jig constructions shown also permit of making partitions serving, for example, as a floor or a ceiling and/or a roof of a building. The structure of the partition, the shape of the jig sides and the height of the jig may be adapted to the shape of the partition to be manufactured. The partitions need not be provided with columns such as the columns 58. If partitions are made without columns, one or more loose peripheral beams may be arranged in the jig. Such peripheral beams can be fixed in place inside the jig by means of safety members such as the safety members 61 and 69 of FIG. 4. However, on the side facing the jig space receiving the cast material the peripheral beam will be smooth so that the cast partition can be removed from these peripheral beams.

Figure 8:
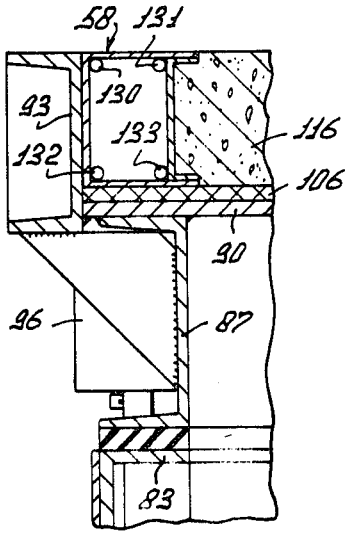
FIG. 8 is a sectional view of part of a jig comparable with the jig of FIG. 6 but having a different safety member.
Figure 9:
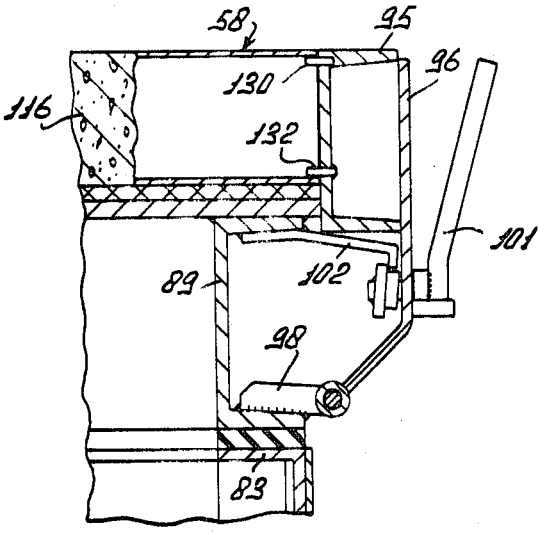
FIG. 9 is a sectional view of the jig portion of FIG. 8 taken on the line IX—IX in FIG. 8.

Although in the embodiments shown, for example, in FIG. 4, the safety members are formed by plates, other shapes are possible. FIGS. 8 and 9 show safety members formed by pins 130 to 133. The pins 130 to 133 are arranged so that they fit in the corners of the rectangular spaces of the hollow columns, for example, the column 58. The portion of a jig shown in FIG. 8 is comparable with the left-hand portion of the jig structure of FIG. 6. FIG. 8 shows, however, a column 58 instead of a beam 120. The portion of the jig structure shown in FIG. 9 is comparable with the portion of the jig structure of FIG. 7. FIG. 9 shows, however, a column 58. Although as shown in FIGS. 8 and 9 the safety pins 130 to 133 fit in the corners of the open ends of a column, it is alternatively possible to fix a column or a peripheral jig beam in the jig by inserting the pins 130 to 133 in a fitting plate having four openings accurately matching the pins 130 to 133. This fitting plate may be arranged in the end of, for example, a column 58 or a peripheral jig beam.

A device embodying the invention is particularly suitable for use in a factory for the prefabrication of partitions. A line of jigs can advantageously join a production line and a production process in which space-bounding building sections are prefabricated, each of which has one or more vertical partitions, a floor and a ceiling and/or a roof. The partitions shown in these embodiments are particularly suitable for building the walls of such sections.

The invention is not restricted to what is stated in the Specification and/or in the claims, but it also relates to the details of the Figures, whether described or not described.

We claim:

1. A device for manufacturing a partition intended as a wall, a floor, a ceiling or roof of a building, said device comprising a jig including a horizontally disposed jig floor having substantially vertical edges about its periphery, upright jig sides each having a substantially vertical portion corresponding to a said vertical edge of said jig floor and providing with said jig floor a mold for forming the partition, substantially horizontally disposed pivot means, the axis of said pivot means being located at a substantially lower level than the top of said jig floor, at least one of said jig sides being arranged to be pivotable about said pivot means whereby said one pivotable jig side with its vertical portion thereof is pivotably displaceable from a position where its vertical portion joins the corresponding vertical edge of said jig floor, a supporting frame provided for supporting said jig floor at least in part, said supporting frame comprising channel beams which each include upper and lower limbs extending outwardly, said pivot means having a pivot shaft mounted on said lower limb of one of said channel beams, a locking member for said one pivotable jig side cooperating with an upper limb of the same one of said channel beams of said supporting frame whereby said vertical portion of said one pivotable jig side is urged against said corresponding vertical edge of said jig floor, said locking member comprising a turnable clamping guide mounted on said one pivotable jig side located to cooperate with a fastening hook, said fastening hook being provided on said upper limb of said one channel beam, said clamping guide being formed by a round disc, the circumference of said disc being interrupted by a straight peripheral portion, the distance between the rotary axis of the locking member and the fastening hook exceeding the distance between said rotary axis and the straight peripheral portion.

2. A device for manufacturing a partition intended as a wall, floor, ceiling or roof of a building, said device comprising a jig formed by a horizontally disposed jig floor including substantially vertical edges thereof and four upright jig sides each including a substantially vertical portion corresponding to a said vertical edge of said jig floor and providing with said floor a mold for forming the partition, pivot means having a pivotal axis which extends substantially horizontally and is disposed at a substantially lower level than the top of said jig floor, each of said jig sides being arranged to be pivotable about said pivot means whereby each jig side and the vertical portion thereof is pivotably displaceable from a position where its vertical portion joins the corresponding vertical edge of said jig floor, a supporting frame which supports said jig floor at least in part, said supporting frame comprising channel beams which include upper and lower limbs thereof extending outwardly, each said pivot means comprising a pivot shaft mounted on a said lower limb of each said channel beam, and a locking member mounted on each said pivotable jig side cooperating with a said upper limb of each said channel beam of said supporting frame, a fastening hook on each said upper limb of each said channel beam, said locking member comprising a turnable clamping guide which cooperates with said fastening hook provided on said upper limb of each said channel beam to urge said vertical portion of each said jig side against a corresponding said vertical edge of said jig floor.

3. A device as claimed in claim 2, wherein said clamping guide comprises a disc which is inclined to its rotary axis.

4. A device as claimed in claim 2, wherein said jig is adapted to receive wall columns, two opposite jig sides being provided with safety members which are adapted to join said wall columns in said jig so as to fix the positions thereof, at least one of said safety members being removable from its position wherein its fixes the position of one of said wall columns.

5. A device as claimed in claim 2, for the manufacture of a partition intended as a wall, floor, ceiling or a roof of a building, wherein facing surfaces of two opposite jig sides are provided with safety members adjacent a third side of said jig, said jig adapted to have wall columns arranged therein so that they are joined by said safety members whereby the positions of said columns are affixed in said jig so as to have a portion flush with the top of said jig, at least one of said safety members being removable from the position in which it affixes the position of a wall column in said jig.

6. A device as claimed in claim 5, wherein at least one of said wall columns is profiled in cross-section and said safety members therefor are adapted closely to conform to each of the inner sides of said one profiled wall column.

7. A device as claimed in claim 5, wherein at least one of said safety members is formed by a plate arranged on the inner surface of the corresponding jig side.

8. A device as claimed in claim 5, wherein on one jig side a plurality of said safety members are arranged in side-by-side relationship whereby the position for a said column in said jig is selective.

9. A device as claimed in claim 5, wherein at least one jig side is formed principally by a plate which is profiled in cross-section.

10. A device as claimed in claim 5, wherein a safety member is provided near each of the ends of said two opposite jig sides.

11. A device as claimed in claim 2, including safety members for supporting columns to be affixed to at least one edge of the partition connected near the top of one of said jig sides, and the jig side opposite thereto, said safety members including protrusions coincident with the corners of a rectangle whereby they are adapted to support columns of rectangular cross-section.

12. A device as claimed in claim 11, wherein at least one said jig side is profiled and includes at least one substantially triangular configuration in cross-section which supports a said safety member.

13. A device in accordance with claim 2, including substantially rectangular configured safety members adapted to position a column to occupy an upper edge of the space defined by said mold, said safety members located on one of said pivotable jig sides and on the opposite jig side whereby, said safety member on said one jig side is withdrawn from the structure of a partition cast in said mold when said one jig side is pivoted away from said jig floor and is adapted to position a column at an upper edge of the space defined by said mold when said one jig side is pivoted and clamped against said floor.

14. A device in accordance with claim 13, wherein said jig floor is provided with a profiled mat.

15. A device in accordance with claim 13, wherein said one jig side is profiled and is at least in part triangular in cross-section substantially throughout its length.

16. A device in accordance with claim 2, wherein two opposite of said jig sides are each provided with safety members which are mounted thereon, at least one of said opposite jig sides being formed principally by a plate which is profiled in cross-section so that said opposite jig sides are closer to each other in the upper part of said mold than in the lower part of said mold, one of said safety members being arranged near the top and one side of said mold, said jig adapted to have wall columns arranged thereon joined by said safety members whereby the positions of said columns are affixed in said jig, a said safety member being included in said pivotable jig side which is removable from the position in which it affixes the position of a wall column in said jig whereby when a plastic hardenable material has been received and hardened in said jig with wall columns affixed therein said hardened material with the wall columns affixed thereto is removable from said jig.

17. Apparatus in accordance with claim 2 comprising a plurality of jigs including said aforementioned jig arranged one behind the other in a jig line, each said jig being formed by a jig floor and upright jig sides, at least one of said jig sides of each said jig being pivotable relative to said jig floor about an axis extending in the direction of said jig line, each said jig forming a mold adapted to receive a plastic hardenable material therein, facing surfaces of two opposite of said jig sides in each said jig being provided with safety members for wall columns adapted to be arranged in the mold formed by each said jig whereby the positions of said columns are affixed in each said mold at an edge and upper position therein, at least one of said safety members in each said jig being included in said jig side which is pivotable about an axis extending in the direction of said jig line whereby it is removable from the position in which it affixes the position of a wall column in each said jig, said jig sides which are pivotable about an axis extending in the direction of said jig line on each said jig being arranged to extend parallel to the direction of the length of said jig line.

18. A device in accordance with claim 2 for manufacturing a partition intended as a wall, a floor, a ceiling or a roof of a building, said device further comprising a profiled mat provided on top of said jig floor including depressed areas for surface facing members adapted to be received therein, said mat having outer vertical edges corresponding substantially to the vertical portions of said upright sides and to the vertical edges of said jig floor, whereby at least one said jig side and the vertical portion thereof is pivotably displaceable from a position where its vertical portion joins the corresponding vertical edges of said jig floor and of said mat.

19. A device as claimed in claim 2, comprising a plurality of like jigs in a line wherein a pivotable jig side is situated in each said jig so as to be transverse to the direction of length of the jig line, and wherein the distance between two consecutive jigs of said line is at least equal to the distance between the pivotal axis of said jig side and the part of the same jig side that is farthest remote from said pivotal axis.

20. A device for the manufacture of a partition intended as a wall, floor, ceiling or roof of a building, said device comprising a supporting frame for a jig, said frame formed by frame beams, said frame beams including upper and lower portions, said jig being formed by a jig floor and upright jig sides, one of said jig sides being pivotable from said lower portion of one of said frame beams substantially outwardly relative to said jig floor and having a locking member connected thereto, said locking member cooperating with locking hook means which is connected to a said upper portion of said one frame beam of said supporting frame, said jig thereby providing a mold adapted to receive a plastic hardenable material therein, facing surfaces of two opposite jig sides being provided with safety members, said jig adapted to receive wall columns arranged therein removably supported and affixed in position by said safety members whereby at least one said safety member is removable from the position in which it affixes the position of a wall column in said jig, said pivotable jig side being formed by a channel-section beam with the two parallel limbs of said channel-section beam being horizontally disposed and extending outwardly relative to said mold, the upper of said limbs being substantially at the same level as the top portion of a said column positioned by a said safety member which is received on the vertical portion of said channel-section beam.

21. A device as claimed in claim 20 wherein said jig floor includes substantially vertical edges thereof and said upright sides each include a substantially vertical portion corresponding to said vertical edges of said jig floor, means in said mold for securing an access frame, a mat provided on top of said jig floor, said mat only covering the part of said jig floor between the location for said access frame and said upright sides, said mat having vertical edges corresponding substantially to the vertical portions of said upright sides and to the vertical edges of said jig floor, said mat including further vertical edges adapted to bear against said access frame, said pivotable one of said jig sides being arranged to be outwardly displaceable whereby said one jig side and the vertical portion thereof is displaceable from a position where its vertical portion joins the corresponding vertical edges of said jig floor and of said mat.

* * * * *